US005397007A

United States Patent [19]

Hanes et al.

[11] Patent Number: 5,397,007

[45] Date of Patent: Mar. 14, 1995

[54] RAILWAY CAR SLACKLESS DRAWBAR ASSEMBLY

[75] Inventors: Douglas M. Hanes; Jeffrey D. Wurzer, both of Pittsburgh; Peter S. Mautino, Verona, all of Pa.

[73] Assignee: McConway & Torley Corporation, Pittsburgh, Pa.

[21] Appl. No.: 148,357

[22] Filed: Nov. 8, 1993

[51] Int. Cl.[6] ..... B61G 7/00

[52] U.S. Cl. ..... 213/50; 213/50.5; 213/54

[58] Field of Search ..... 213/50, 50.5, 56, 58, 213/60, 67 R, 67 A, 68, 69, 70, 71, 72

[56] References Cited

U.S. PATENT DOCUMENTS

| | | | |
|---|---|---|---|
| 1,877,335 | 9/1932 | Lounsbury | 213/50 |
| 4,078,669 | 3/1978 | Peterson et al. | 213/50.5 |
| 4,422,557 | 12/1983 | Altherr | 213/62 R |
| 4,456,133 | 6/1984 | Altherr et al. | 213/62 R |
| 4,549,666 | 10/1985 | Altherr et al. | 213/62 R |
| 4,580,686 | 4/1986 | Elliott | 213/62 A |
| 4,593,827 | 6/1986 | Altherr | 213/50 |
| 4,681,040 | 7/1987 | Brodeur et al. | 105/3 |
| 4,863,045 | 9/1989 | Altherr | 213/78 |
| 4,966,291 | 10/1990 | Glover | 213/71 |
| 5,002,192 | 3/1991 | Kaufhold | 213/61 |
| 5,097,973 | 3/1992 | Spencer | 213/50 |
| 5,201,827 | 4/1993 | Glover et al. | 213/50.5 |
| 5,207,718 | 5/1993 | Glover et al. | 213/50.5 |
| 5,312,007 | 5/1994 | Kaufhold et al. | 213/50 |

FOREIGN PATENT DOCUMENTS

| | | | |
|---|---|---|---|
| 0594689 | 6/1959 | Italy | 213/61 |

*Primary Examiner*—Mark T. Le

*Attorney, Agent, or Firm*—James Ray & Associates

[57] ABSTRACT

A drawbar assembly having a rear draft stop engageable with a block out member. A tapered wedge member engages a tapered surface on the block out member. A follower member engages a front face of the tapered wedge. A concave surface is formed in a front face portion of the follower member. Such follower member is movable within the open end of a yoke casting. Such yoke casting includes first and second side walls, a top wall and a bottom wall. A first and second aperture are formed through the top wall and bottom wall, respectively. A pair of front draft stop members engage a respective side wall of such center sill. A drawbar having a butt end portion is movably disposed within a second opening in such yoke casting. Such drawbar includes a vertically disposed pin receiving opening formed in such butt end and a two piece pin bearing block having a hemispherical outer surface is disposed in a hemispherical recess formed in such pin receiving opening. A vertically disposed pin member is disposed within such first aperture in such top wall of the yoke casting, such pin receiving opening in such drawbar and the second aperture formed in such bottom wall portion of such yoke casting.

20 Claims, 3 Drawing Sheets

FIG. 2
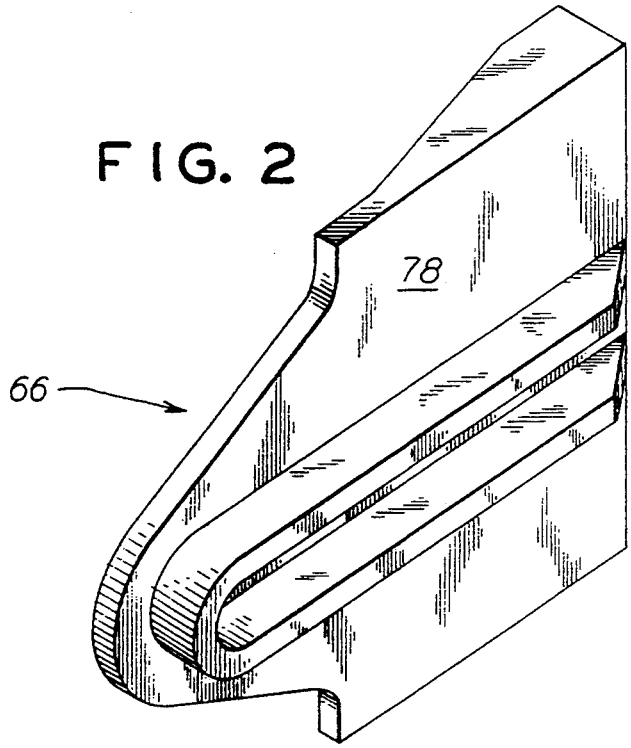
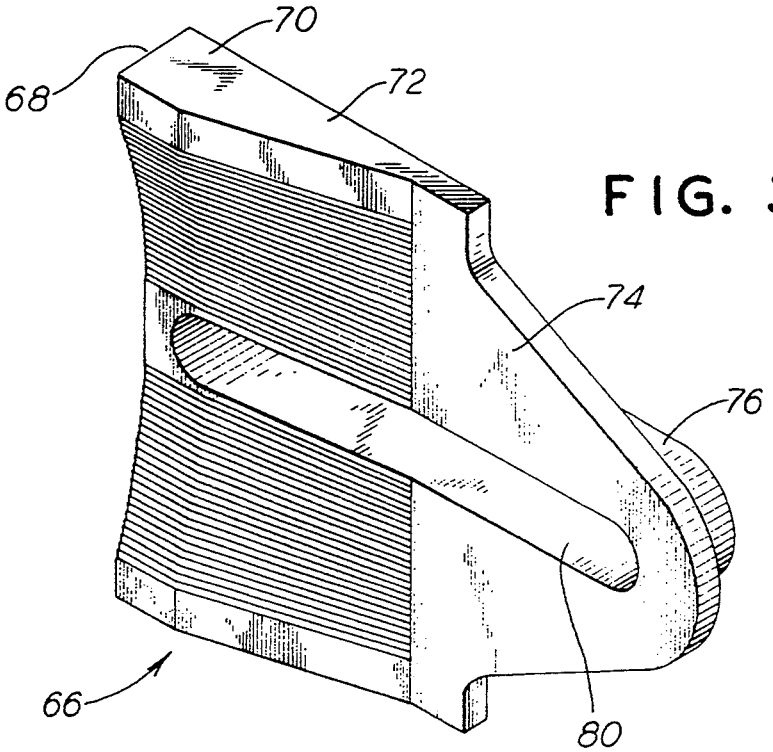
FIG. 3

RAILWAY CAR SLACKLESS DRAWBAR ASSEMBLY

FIELD OF THE INVENTION

The present invention relates, in general, to slackless drawbar assemblies used in connecting adjacent predetermined ends of a pair of railway cars together, in a more or less substantially semipermanent manner, and, more particularly, this invention relates to an improved slackless drawbar assembly for use in this application.

CROSS REFERENCE TO RELATED APPLICATIONS

This patent application is closely related to a patent application titled "YOKE CASTING FOR A DRAWBAR ASSEMBLY" Ser. No. 08/148,379, filed Nov. 8, 1993 and a patent application titled "FRONT DRAFT STOP FOR USE IN A DRAWBAR ASSEMBLY" Ser. No. 08/149,054, filed Nov. 8, 1993, each of these patent applications is being filed concurrently herewith and they are assigned to the same assignee. Further, each of these patent applications is incorporated herein by reference thereto.

BACKGROUND OF THE INVENTION

It is well known, in the railroad industry, that railway cars can be connected together by different types of coupler members. Such couplers may be conventional couplers, articulated couplers or drawbars. Conventional couplers are independent units disposed on an end of each car which interconnect with one another, between the ends of adjacent cars, to form a connection. Conventional couplers are used on cars which generally require frequent disconnections. On the other hand, drawbar assemblies are integral units which extend between the ends of two adjacent cars to form a generally semipermanent connection therebetween. Nevertheless, in either instance, a shank end of the coupler or drawbar will extend into the center sill portion of a railway car where it is secured so as to transmit the longitudinal forces exerted to the car during in track service. Additionally, each type coupler system requires the use of generally common components to enable draft loads to be safely applied to the end of the railway car. For example, yokes, draft stops (front and rear) and draft keys.

In addition, some prior inventions have been directed to improvements in the center sill construction for receiving primarily conventional couplers. However, these improvements may also have application in receiving couplers in a slackless drawbar arrangement. By slackless, it is meant that the drawbar (or coupler) is received within the center sill member in a manner to minimize longitudinal play or movements. However, because it is important for successive railway cars in a train to be able to accommodate relative movement between cars when curves and inclines are to be negotiated, there must be provision made for each car to move in pitch, yaw and roll modes with respect to the coupler member. Furthermore, there must be some provision made to periodically remove the worn and/or broken draft components for repair and/or replacement of parts and, in connection with the slackless drawbar systems, to disconnect adjacently connected railway cars.

In a slackless drawbar system, for example, the coupler member is usually held in a way to eliminate, or at least minimize, the longitudinal movement with respect to the railway car body. This is usually accomplished by providing a tapered wedge member between a rear wall of a pocket casting, or yoke, (secured in the center still) and a follower block member which rests against the butt end of the drawbar member. The tapered wedge member tends to force the follower block member away from the pocket casting end wall and firmly against the butt end of the drawbar member shank. When the cars are being pushed, during operation, the longitudinal forces exerted will cause compression of the drawbar member against the follower block member, tapered wedge member and pocket casting end wall.

Conversely, when the railway cars are being pulled, the longitudinal forces being exerted, which tend to separate the drawbar from the pocket casting, are countered in some slackless drawbar systems by a draft key which is a metal bar that extends laterally of the car center sill member through slots provided in the sidewalls of the center sill member and a slot formed in the shank portion of the coupler member and in other slackless drawbar systems through slots which are formed through the front draft stop members.

In such slackless drawbar systems, the drawbar is held tightly between the bearing block member and the follower block member by operation of the tapered wedge member which separates the pocket casting and follower block member and compresses the follower block member against the drawbar to force the latter against the bearing block member and the follower block member. However, the mating surfaces of the follower block member and drawbar are, preferably, curved to permit the drawbar to pivot slightly both a vertically and a lateral direction and to permit the railway car to roll with respect to the drawbar.

SUMMARY OF THE INVENTION

The present invention provides an improved slackless drawbar assembly for connecting adjacent predetermined ends of a pair of railway cars together in a substantially semipermanent manner. Such slackless drawbar assembly includes a rear draft stop member engageable with a vertically disposed side wall of a center sill member located substantially along a longitudinal axis of a railway car body member. The rear draft stop member has a vertically disposed substantially flat front face portion facing an open end of such center sill member. A block out member having a vertically disposed and substantially flat rear face portion is provided. At least a portion of the rear face engages such vertically disposed substantially flat front face portion of the rear draft stop member. Such block out member has a front face portion disposed axially opposite the rear face portion. At least a portion of such front face portion is tapered upwardly from a predetermined point on the front face portion and inwardly toward such rear face portion. A tapered wedge member having a tapered surface is engageable with the tapered portion of such block out member. Such tapered wedge member having a vertically disposed substantially flat face portion disposed axially opposite such tapered surface. A follower member is provided having a rear surface engageable with the vertically disposed flat face portion of the tapered wedge member and a concave surface formed in a front face portion thereof. This slackless drawbar arrangement has an integral single piece yoke casting which is open at each end thereof. The yoke casting receives the follower member within a rear opening thereof for longitudinal movement therein. The yoke casting includes a first vertically disposed generally rectangular shaped side wall portion having a vertically disposed substantially flat front face portion and a second vertically disposed generally rectangular shaped side wall portion, also, having a vertically disposed substantially flat front face portion. The yoke casting further has a horizontally disposed top wall portion and a horizontally disposed bottom wall portion. A first vertically disposed aperture, having a predetermined diameter, is formed through the top wall portion at a predetermined and an axially opposed second vertically disposed aperture, having a predetermined diameter is formed through the bottom wall portion at a predetermined location. The slackless drawbar assembly further includes a pair of front draft stop members engageable with a respective vertically disposed side wall of such center sill member. Each of such pair of front draft stop members including a generally rectangular shaped block-like member having a vertically disposed substantially flat rear face portion engageable with the front face portion of a respective one of such first side wall portion and such second side wall portion of the yoke casting. This rectangular block-like member has a first arcuately shaped portion extending forwardly from the vertically disposed rear face portion and inwardly from an upper surface of such front draft stop member and terminating short of a longitudinal centerline of the front draft stop member. A second arcuately shaped portion of such block-like member extends forwardly from such vertically disposed rear face portion and inwardly from a bottom surface of the front draft stop member and terminates short of such longitudinal centerline of the front draft stop member. The front draft stop member further has a generally triangular shaped block-like member formed integrally with such generally rectangular shaped block-like member adjacent an inner portion thereof. This generally triangular shaped block-like member has a third arcuately shaped portion beginning inwardly from such upper surface of the front draft stop member and terminating short of such longitudinal centerline and a fourth arcuately shaped portion beginning inwardly from such bottom surface of such front draft stop member and, also, terminating short of such longitudinal centerline. The triangular block-like member has a nose member formed integrally therewith adjacent an inner portion thereof. Such nose member having an arcuately shaped end portion disposed axially opposite the rear face portion of the generally rectangular shaped block-like member. The nose portion has a tapered upper surface extending inwardly toward the rear face portion from a first end of such arcuately shaped end and upwardly from such longitudinal centerline of such front draft stop member and a tapered bottom surface extending inwardly toward such rear face portion from a second end of the arcuately shaped end and outwardly from such longitudinal centerline of the front draft stop member. An upper arcuately shaped portion is disposed between one end of the tapered upper surface and a point beginning inwardly from such upper surface of the front draft stop member. A bottom arcuately shaped portion begins at one end of such bottom tapered surface and ends at a point inwardly from a bottom surface of the front draft stop member. An elongated draft key slot receiving member is disposed on an outer surface of such front draft stop member substantially along such longitudinal centerline and an elongated slot is formed through such front draft stop member substantially along the longitudinal centerline thereof. A drawbar having a butt end portion is movably disposed within a second opening in such yoke casting. Such drawbar includes a vertically disposed pin receiving opening formed in the butt end portion. A two piece pin bearing block, having a hemispherical outer surface, is disposed in a hemispherical recess formed in such pin receiving opening. The slackless drawbar assembly has a vertically disposed pin member disposed within such first aperture in the top wall portion of the yoke casting, such pin receiving opening in such drawbar and such second aperture formed in such bottom wall portion of the yoke casting.

OBJECTS OF THE INVENTION

It is, therefore, one of the primary objects of the present invention to provide an improved slackless drawbar system which can be readily retrofitted to existing railway cars with relatively few modifications being required.

Another object of the present invention is to provide an improved slackless drawbar assembly having a front draft stop member which is strong and relatively light weight.

Still another object of the present invention is to provide an improved slackless drawbar assembly having a front draft stop member which does not require lightener holes to achieve a minimum weight.

Yet another object of the present invention is to provide an improved slackless drawbar assembly having a front draft stop member which is relatively simple to manufacture.

A further object of the present invention is to provide an improved slackless drawbar assembly having a front draft stop member which requires a minimum amount of maintenance.

An additional object of the present invention is to provide an improved slackless drawbar assembly having a front draft stop member which is less complex to cast.

A further object of the present invention is to provide an improved slackless drawbar assembly having an integral single piece yoke casting.

Another object of the present invention is to provide a yoke for use in the slackless drawbar system which is relatively easy to install.

Still another object of the present invention is to provide a yoke for use in a slackless drawbar system which will not separate when buff and draft loads are applied thereto by in train actions encountered.

Yet another object of the present invention is to provide a yoke for use the slackless drawbar system which will require less maintenance.

A further object of the present invention is to provide a yoke for use in the slackless drawbar system which is relatively light weight.

An additional object of the present invention is to provide a yoke for use in the slackless drawbar system which can be retrofitted to existing slackless drawbar assemblies and to existing railway cars.

Still another object of the present invention is to provide a yoke for use in the slackless drawbar system which will enable freer movement of the drawbar within the yoke.

In addition to the various objects and advantages of the improved slackless drawbar assembly discussed above, it should be understood that various other objects and advantages of the present invention will become more readily apparent to those persons who are skilled in the railway coupling art from the following more detailed description, particularly, when such description is taken in conjunction with the attached drawing Figures and with the appended claims.

BRIEF DESCRIPTION OF THE DRAWINGS

FIG. 2 is a perspective view showing the presently preferred front draft stop member with a draft key slot;

FIG. 3 is a perspective view looking at the inner surface of the front draft stop member illustrated in FIG. 2.

DESCRIPTION OF THE PREFERRED EMBODIMENTS OF THE INVENTION

Figure 1:
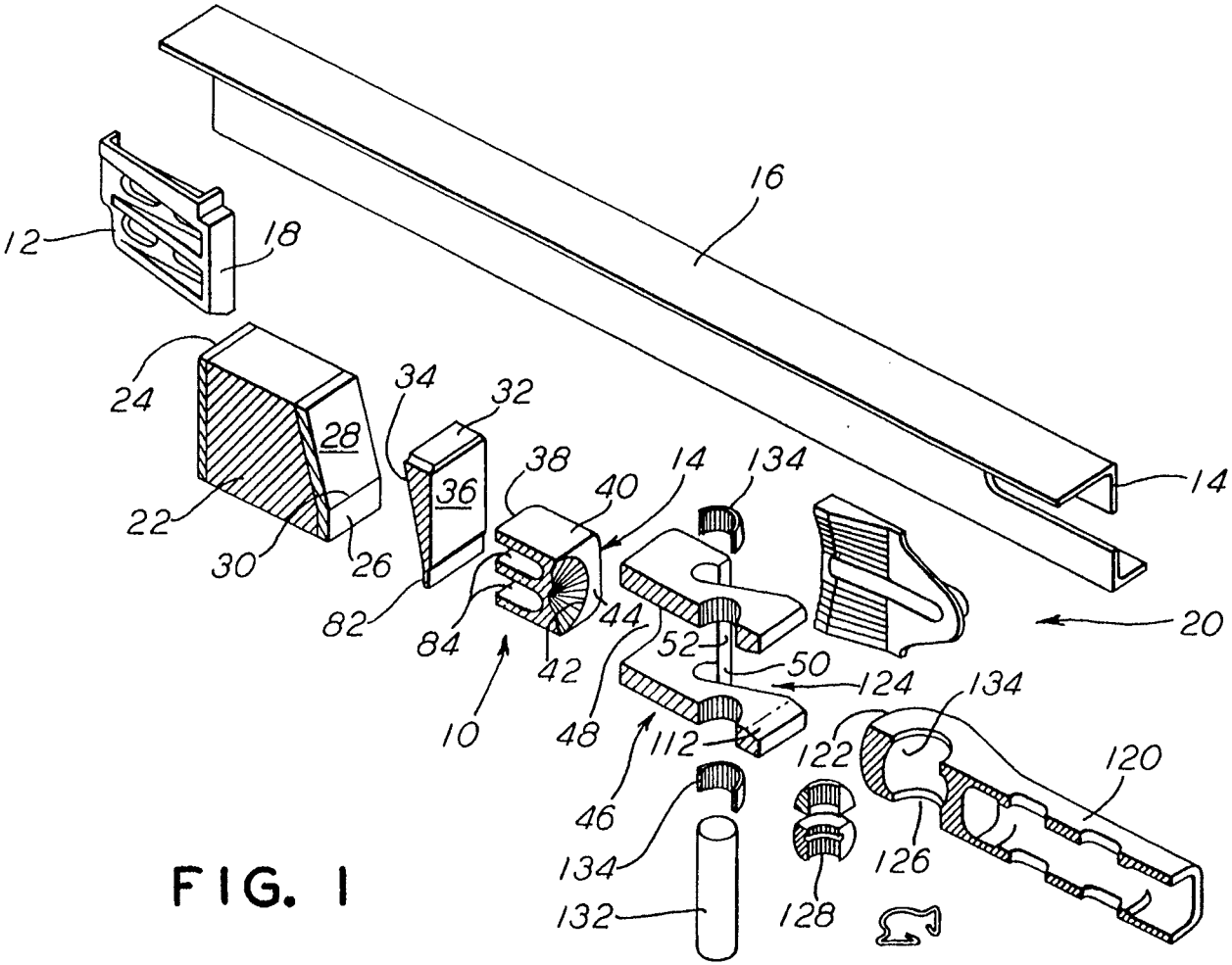
FIG. 1 is an exploded view partially in cross-section which illustrates the presently preferred slackless drawbar assembly, manufactured according to the instant invention.

Prior to proceeding to the more detailed description of the instant invention, it should be noted that for the sake of clarity, identical components, having identical functions, have been designated with identical reference numerals throughout the several drawing Figures.

Now refer, more particularly, to FIG. 1 of the drawings. Illustrated therein, is an improved slackless drawbar assembly, generally designated, 10 for connecting adjacent ends (not shown) of a pair of railway cars (not shown) together in a substantially semipermanent manner.

The slackless drawbar assembly 10 includes at least one rear draft stop member 12 which is secured to a vertically disposed side wall 14 of a center sill member 16 located substantially along a longitudinal centerline of a railway car body member (not shown). Such rear draft stop member 12 has a vertically disposed substantially flat front face portion 18 which faces the open end 20 of such center sill member 16. In the presently preferred embodiment of the invention, there are two rear draft stop members 12 used which are disposed axially opposite to one another.

A block out member 22 has a vertically disposed and substantially flat rear face portion 24. At least a portion of such rear face portion 24 engages the front face portion 18 of such rear draft stop member 12. Block out member 22 has a front face portion 26 disposed axially opposite rear face portion 24. At least a portion 28 of the front face portion 26 is tapered upwardly from a predetermined point 30 on such front face portion 26 and inwardly toward the rear face portion 24. Such block out member 22 may be either a single piece casting, a fabricated member or an adjustable block out member and still be within the scope of the instant invention.

Included in the slackless drawbar assembly 10 is a tapered wedge member 32 which has a tapered surface 34 engageable with the tapered surface 38 of block out member 22. Such tapered wedge member 32 has a vertically disposed substantially flat face portion 36 disposed axially opposite such tapered surface 34. Preferably, such tapered wedge member 32 includes a wear indicating means 82 located adjacent a bottom end thereof for indicating wear on such slackless drawbar assembly 10.

A rear surface 38 of a follower member 40 is engageably with such flat face portion 36 of the tapered wedge member 32. Follower member 40 has a concave surface 42 formed in the front face 44 thereof. To reduce the weight of such follower member 40 there are preferably a number of cavities 84 formed therein which begin adjacent the rear surface 38 thereof and extend toward such front face portion 44 for a predetermined distance.

Figure 4:
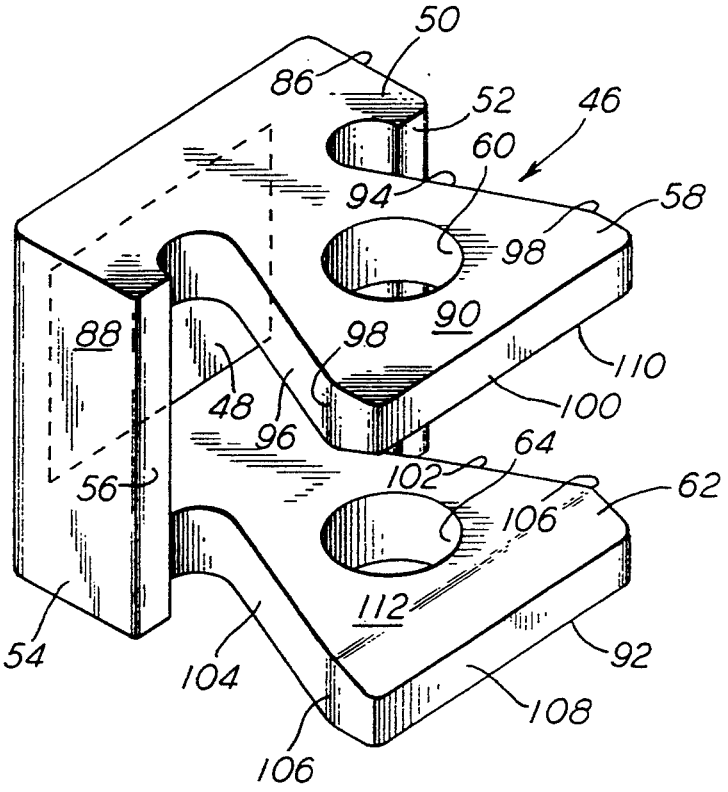
FIG. 4 is a perspective view which illustrates all of the essential elements of a presently preferred integral single piece yoke casting, according to the presently preferred embodiment of the invention.

As best seen in FIG. 4, another essential element of the slackless drawbar assembly 10 is an integral single piece yoke casting, generally designated, 46 which is open at each end thereof. The yoke casting 46 receives the follower member 40 within a rear opening 48 thereof for longitudinal movement therein. A more complete description of the yoke casting 46 is provided in our copending application referred to above. Therefore, for the sake of brevity, only the most essential elements of yoke casting 46 will be described hereinafter. These elements include a first vertically disposed generally rectangular shaped side wall portion 50. The first side wall portion 50 has a vertically disposed and substantially flat front face portion 52. Yoke casting 46 has a second vertically disposed generally rectangular shaped side wall portion 54. Second side wall portion 54, like the first side wall portion 50, has a vertically disposed and substantially flat front face portion 56. Additionally, yoke casting 46 includes a horizontally disposed top wall portion 58 having a first vertically disposed aperture 60 formed therethrough at a predetermined location and a horizontally disposed bottom wall portion 62 which has an axially opposed second vertically disposed aperture 64 formed therethrough. According to the presently preferred embodiment, a predetermined length of each of the top wall portion 58 and the bottom wall portion 62 of such yoke casting is at least twice as long as a predetermined length of both such first side wall portion 50 and the second side wall portion 54. Additionally, the first predetermined diameter of the first aperture 60 in the top wall 58 is substantially identical to the second predetermined diameter of the second aperture 64 in the bottom wall 62 of yoke casting 46. An outer surface 86 of such first side wall portion 50, the outer surface 88 of such second side wall portion 54, the upper surface 90 of such top wall portion 58 and the bottom surface 92 of such bottom wall portion 62 form a generally rectangular shape having a predetermined height and a predetermined width which closely corresponds to a height and a width of such longitudinal opening in such center sill member 14. Further, in the preferred embodiment, each outer surface 94 and 96 of such top wall portion 58 is tapered inwardly toward a longitudinal centerline of the yoke casting 46 at a predetermined angle and rearwardly for a predetermined distance from a predetermined point 98 disposed a predetermined distance from a front face 100 of such top wall portion 58. Likewise, each outer surface 102 and 104 of such bottom wall portion 62 is tapered inwardly toward the longitudinal centerline of the yoke casting 46 at a predetermined angle and rearwardly for a predetermined distance from a predetermined point 106 disposed a predetermined distance from a front face 108 of such bottom wall portion 62. Preferably, a bottom surface 110 of such top wall portion 58 is tapered downwardly at a first predetermined angle and inwardly toward such longitudinal centerline from the front face portion 100 of such top wall portion 58 for a first predetermined distance. The top surface 112 of such bottom wall portion 62 is also tapered upwardly at a second predetermined angle and inwardly toward such longitudinal centerline from the front face portion 108 of such bottom wall portion 62 for a second predetermined distance.

Now refer, more particularly, to FIGS. 2 and 3. Illustrated therein is an integral single piece front draft stop member, generally designated, 66 which is another essential element of the slackless drawbar system 10, according to the present invention. It being understood that two such front draft stop members 66 are required. Preferably, each of such pair of front draft stop members is an integral single piece casting. A more complete description of the front draft stop members 66 is provided in our copending application referred to above. Therefore, for the sake of brevity, only the most essential elements of such front draft stop members 66 will be described hereinafter. The front draft stop members 66, of the present invention, includes a vertically disposed substantially flat rear face portion 68, located at one end of a generally rectangular block-like portion 70, engageable with a respective flat face 52 and 56 (FIG. 4) of yoke casting 46. Front draft stop member 66 also includes a generally triangular shaped block-like member 72 formed integrally with such rectangular block-like member 70 adjacent an inner portion thereof. A nose member 74 is formed integrally with the triangular block-like member 72 adjacent an inner portion thereof. An elongated draft key slot receiving member 76 is disposed on an outer surface 78 of such front draft stop member 66 substantially along the longitudinal centerline. Such elongated draft key slot receiving member 76 is preferably U-shaped. The final essential element of front draft stop member 66 is an elongated slot 80, having a predetermined length, formed through such front draft stop member 66 substantially along the longitudinal centerline. Such elongated slot 80 receives a draft key (not shown) therein. Each end of such elongated slot 80 is preferably arcuately shaped.

Slackless drawbar assembly 10 includes a drawbar 120 having a convex shaped butt end portion 122 engageable with the concave surface 42 formed in the front face portion 44 of follower member 40. Preferably, both the convex shaped butt end portion 122 of the drawbar 120 and such concave surface 42 formed in such follower member 40 are hardened to provide increased wear resistance. Drawbar 120 is movably disposed within a second opening 124 in the yoke casting 46. The drawbar 120 includes a vertically disposed pin receiving opening 126 formed in the butt end portion. A two piece pin bearing block 128 is disposed in a hemispherical recess 130 formed in such pin receiving opening 126. Two piece pin bearing block 128 is more fully described in a copending application titled "IMPROVED DRAWBAR BEARING BLOCK" and which is assigned to the same assignee. This application was filed on Oct. 25, 1993 and was assigned Ser. No. 08/142,576, now U.S. Pat. No. 5,361,917. The disclosure of this application is incorporated herein by reference thereto.

The slackless drawbar assembly 10 includes a vertically disposed pin member 132 positioned within the first aperture 60, the pin receiving opening 126 and the second aperture 64 for retaining the butt end portion of the drawbar 120 in the yoke casting 46.

In the presently preferred embodiment, the slackless drawbar assembly 10 further includes a wear ring 134 disposed intermediate an outer surface of said pin member 132 and such first and second apertures 60 and 64 formed in the top wall portion 58 and such bottom wall portion 52, respectively, of the yoke casting 46.

Although a number of presently preferred embodiments of the improved slackless drawbar assembly have been described in detail above, it should be understood that various other modifications and adaptations of the instant invention may be made by persons skilled in the railroad coupling art without departing from the spirit and scope of the appended claims.

We claim:

1. An improved slackless drawbar assembly for connecting adjacent predetermined ends of a pair of railway cars together in a substantially semipermanent manner, said slackless drawbar assembly comprising:

(a) a rear draft stop member engageable with at least one vertically disposed side wall portion of a center sill member located substantially along a longitudinal centerline of a railway car body member, said rear draft stop member having a vertically disposed substantially flat front face portion facing an open end of such center sill member;

(b) a block out member having a vertically disposed and substantially flat rear face portion at least a portion of which engages said vertically disposed substantially flat front face portion of said rear draft stop member, said block out member having a front face portion disposed axially opposite said rear face portion, at least a portion of said front face portion being tapered upwardly from a predetermined position on said front face portion and inwardly toward said rear face portion;

(c) a tapered wedge member having a tapered surface engageable with said tapered portion disposed on said front face of said block out member, said tapered wedge member having a vertically disposed substantially flat face portion disposed axially opposite said tapered surface;

(d) a follower member having a rear surface engageable with said vertically disposed flat face portion of said tapered wedge member and a concave surface formed in a front face portion thereof;

(e) an integral single piece yoke casting open at each end thereof, said yoke casting receiving said follower member within a rear opening thereof for longitudinal movement therein, said yoke casting including, (i) a first vertically disposed generally rectangular shaped side wall portion, said first side wall portion having a vertically disposed substantially flat front face portion, (ii) a second vertically disposed generally rectangular shaped side wall portion, said second side wall portion having a vertically disposed substantially flat front face portion, (iii) a horizontally disposed top wall portion, (iv) a horizontally disposed bottom wall portion, (v) a first vertically disposed aperture, having a first predetermined diameter, formed through said top wall portion at a predetermined location, and (vi) an axially opposed second vertically disposed aperture, having a second predetermined diameter, formed through said bottom wall portion at a predetermined location;

(f) a pair of front draft stop members engageable with a respective vertically disposed side wall of such center sill member, each of said pair of front draft stop members including, (i) a generally rectangular shaped block-like member having a vertically disposed substantially flat rear face portion engageable with said front face portion of a respective one of said first side wall portion and said second side wall portion of said yoke casting, a first arcuately shaped portion extending forwardly from said vertically disposed rear face portion and inwardly from an upper surface of said front draft stop member and terminating short of a longitudinal centerline of said front draft stop member, a second arcuately shaped portion extending forwardly from said vertically disposed rear face portion and inwardly from a bottom surface of said front draft stop member and terminating short of said longitudinal centerline of said front draft stop member, (ii) a generally triangular shaped block-like member formed integrally with said generally rectangular shaped block-like member adjacent an inner portion thereof, said generally triangular shaped block-like member having a a third arcuately shaped portion beginning inwardly from said upper surface of said front draft stop member and terminating short of said longitudinal centerline and a fourth arcuately shaped portion beginning inwardly from said bottom surface of said front draft stop member and terminating short of said longitudinal centerline, (iii) a nose member formed integrally with said generally triangular shaped block-like member adjacent an inner portion thereof, said nose member having an arcuately shaped end portion disposed axially opposite said rear face portion of said generally rectangular shaped block-like member, a tapered upper surface extending inwardly toward said rear face portion from a first end of said arcuately shaped end and upwardly from said longitudinal centerline of said front draft stop member, a tapered bottom surface extending inwardly toward said rear face portion from a second end of said arcuately shaped end and outwardly from said longitudinal centerline of said front draft stop member, an upper arcuately shaped portion disposed between one end of said tapered upper surface and a point beginning inwardly from said upper surface of said front draft stop member and a bottom arcuately shaped portion beginning at one end of said bottom tapered surface and ending at a point inwardly from said bottom surface of said front draft stop member, (iv) an elongated draft key slot receiving member disposed on an outer surface of said front draft stop member substantially along said longitudinal centerline, and (v) an elongated slot formed through said front draft stop member substantially along said longitudinal centerline;

(g) a drawbar having a butt end portion engageable with said concave surface formed in said front face portion of said follower member and movably disposed within a second opening in said yoke casting, said drawbar including a vertically disposed pin receiving opening formed in said butt end portion and a two piece pin bearing block having a hemispherical outer surface disposed in a hemispherical recess formed in said pin receiving opening, and (h) a vertically disposed pin member disposed within said first aperture in said top wall portion of yoke casting, said pin receiving opening in said drawbar and said second aperture formed in said bottom wall portion of said yoke casting for retaining said butt end portion of said drawbar in said yoke casting.

2. An improved slackless drawbar assembly, according to claim 1, wherein said slackless drawbar assembly includes a pair of rear draft stop members disposed axially opposite one another.

3. An improved slackless drawbar assembly, according to claim 1, wherein said block out member is a single piece casting.

4. An improved slackless drawbar assembly, according to claim 1, wherein said block out member is fabricated.

5. An improved slackless drawbar assembly, according to claim 1, wherein said block out member is adjustable.

6. An improved slackless drawbar assembly, according to claim 1, wherein said tapered wedge member includes a wear indicating means adjacent a bottom end thereof for indicating wear on said slackless drawbar assembly.

7. An improved slackless drawbar assembly, according to claim 1, wherein said follower member includes a plurality of cavities formed therein beginning adjacent said rear surface thereof and extending toward said front face portion for a predetermined distance.

8. An improved slackless drawbar assembly, according to claim 1, wherein a predetermined length of said horizontally disposed top wall portion and said horizontally disposed bottom wall portion of said yoke casting is at least twice as long as a predetermined length of said first side wall portion and said second side wall portion.

9. An improved slackless drawbar assembly, according to claim 8, wherein said first predetermined diameter of said first aperture is substantially identical to said second predetermined diameter of said second aperture.

10. An improved slackless drawbar assembly, according to claim 9, wherein said outer surface of said first side wall portion, said outer surface of said second side wall portion, said upper surface of said top wall portion and said bottom surface of said bottom wall portion form a generally rectangular shape having a predetermined height and a predetermined width which closely corresponds to a height and a width of such longitudinal opening in such center sill member.

11. An improved slackless drawbar assembly, according to claim 10, wherein each outer surface of said top wall portion is tapered inwardly toward a longitudinal centerline of said yoke casting at a predetermined angle and rearwardly for a predetermined distance from a predetermined point disposed a predetermined distance from a front face of said top wall portion.

12. An improved slackless drawbar assembly, according to claim 11, wherein each outer surface of said bottom wall portion is tapered inwardly toward said longitudinal centerline of said yoke casting at said predetermined angle and rearwardly for said predetermined distance from said predetermined point disposed said predetermined distance from a front face of said bottom wall portion.

13. An improved slackless drawbar assembly, according to claim 12, wherein a bottom surface of said top wall portion is tapered downwardly at a first predetermined angle and inwardly toward said longitudinal centerline from a front face portion of said top wall portion for a first predetermined distance.

14. An improved slackless drawbar assembly, according to claim 13, wherein a top surface of said bottom wall portion is tapered upwardly at a second predetermined angle and inwardly toward said longitudinal centerline from a front face portion of said bottom wall portion for a second predetermined distance.

15. An improved slackless drawbar assembly, according to claim 1, wherein each of said pair of front draft stop members is an integral single piece casting.

16. An improved slackless drawbar assembly, according to claim 15, wherein said elongated draft key slot receiving member is substantially U-shaped.

17. An improved slackless drawbar assembly, according to claim 16, wherein said each end of said elongated slot formed through each of said front draft stop members is arcuately shaped.

18. An improved slackless drawbar assembly, according to claim 1, wherein both said convex shaped butt end portion of said drawbar and said concave surface formed in said follower member are hardened to provide increased wear resistance.

19. An improved slackless drawbar assembly, according to claim 1, wherein said slackless drawbar assembly further includes a wear ring disposed intermediate an outer surface of said pin member and said first and second aperture formed in said top wall portion and said bottom wall portion, respectively, of said yoke casting.

20. An improved slackless drawbar assembly, according to claim 1, wherein said each of said pair of draft stop members is fabricated.

* * * * *

UNITED STATES PATENT AND TRADEMARK OFFICE

CERTIFICATE OF CORRECTION

PATENT NO. : 5,397,007

DATED : March 14, 1995

INVENTOR(S) : Douglas M. Hanes, et al.

It is certified that error appears in the above-identified patent and that said Letters Patent is hereby corrected as shown below:

Column 2, line 33, after "slightly", please insert --in--.
Column 4, line 53, after "use", please insert --in--.
Column 5, line 32, after "designated", please delete ",";
column 5, line 32, after "10", please insert --,--.
Column 6, line 1, please delete "engage-" and insert --engagable--;
column 6, line 2, please delete "ably";
column 6, line 11, after "designated", please delete ",";
column 6, line 11, after "46", please insert --,--.
Column 7, line 7, after "designated", please delete ",";
column 7, line 7, after "66", please insert --,--.
Column 9, line 22, please delete "a" (second occurrence).

Signed and Sealed this

Fourth Day of January, 2000

*Attest:*

*Attesting Officer*

*Acting Commissioner of Patents and Trademarks*